United States Patent [19]

Solano

[11] Patent Number: 4,662,090

[45] Date of Patent: May 5, 1987

[54] BICYCLE SHOE

[76] Inventor: Mike L. Solano, 1416 West Point Dr., Bakersfield, Calif. 93305

[21] Appl. No.: 840,218

[22] Filed: Mar. 17, 1986

[51] Int. Cl.[4] ..... A43B 5/14

[52] U.S. Cl. ..... 36/131; 74/594.6

[58] Field of Search ..... 36/131, 132; 74/594.6

[56] References Cited

U.S. PATENT DOCUMENTS

| | | | |
|---|---|---|---|
| 589,443 | 9/1897 | Rathbun | 36/131 X |
| 3,964,343 | 6/1976 | Lauterbach | 74/594.6 |
| 4,188,737 | 2/1980 | Haver | 36/131 |
| 4,538,480 | 9/1985 | Trindle | 74/594.6 |

FOREIGN PATENT DOCUMENTS

| | | | |
|---|---|---|---|
| 0015803 | 9/1980 | European Pat. Off. | 74/594.6 |
| 11890 | of 1892 | United Kingdom | 36/131 |

*Primary Examiner*—James Kee Chi

*Attorney, Agent, or Firm*—Julius L. Rubinstein

[57] ABSTRACT

A bike show is formed with a recess in the sole of the shoe. The recess is defined by front and rear walls transverse to an inwardly and upwardly spaced base, with the recess extending from the opposite sides of the sole forming a channel. The front and rear walls of the recess are spaced apart a distance generally equal to the width of a bike pedal to provide a stable seat for the pedal inside the recess. The recess is located so that the center of the recess is aligned with the center of the ball of the foot of the bike rider when the rider is wearing the bike shoe, for maximum transfer of power from the bike rider to the pedal of the bike.

10 Claims, 4 Drawing Figures

BICYCLE SHOE

This invention relates to a shoe and more particularly to a shoe for riding bicycles used in Moto Cross competition.

BACKGROUND AND PRIOR ART

In recent years the sport of Moto Cross competition has been gaining increasingly wide acceptance. In this sport, the bicycles are raced along a track full of obstacles which require the rider, among other things, to jump the bicycle over these obstacles. In order to maintain control of the bicycle during these jumps and while the bicycle is travelling over rough terrain, it is essential that the feet of the rider remain in contact with the bike pedal, otherwise, valuable time may be lost while the rider is trying to reposition his feet on the pedal. In addition, successful competition requires that power be transmitted from the bike rider to the pedal of the bike with maximum efficiency.

Heretofore efforts were made to provide bicycle shoes which were designed to hold the shoe in contact with the pedal. These efforts are exemplified by the patents to Haver, U.S. Pat. No. 4,188,737; Polsky, U.S. Pat. No. 3,952,428; McIntyre, U.S. Pat. No. 598,325; Rathbun, U.S. Pat. No. 589,443, and the French Pat. No 2,532,530 to Danielli and the French Pat. No. 2,301,193 to Soubirac.

These patents solved the problem of maintaining the bike shoe in contact with a bike pedal by forming a recess in the sole of the shoe for engaging at least a part of the bike pedal, or by installing a device on the sole of the shoe for attachment to the pedal. However, none of the prior art bike shoes were particularly suited for competitive Moto Cross competition and many were uncomfortable to walk on.

More importantly, prior art bike shoe designers did not consider the necessity of designing the bike shoe for holding the shoe in a stable position in contact with the pedal while the bicycle is riding over rough terrain during competition. In addition, the prior art bike shoe designers did not adequately consider the importance of designing the shoe to provide for the maximum transfer of power between the bike shoe and the pedal.

The patent to Haver U.S. Pat. No. 4,188,737 which superficially resembles Applicant's bike shoe has the advantage that it is reasonably comfortable to walk on and does not mar or scratch floor surfaces. Its disadvantage from the standpoint of Moto Cross competition is that it does not hold the bike shoe in a stable position in contact with the pedal and the location of the shoe with respect to the pedal does not provide for the maximum transfer of power.

The reason that the bike shoe shown in the Haver patent does not hold the bike shoe in a stable position over the pedal is that the walls of the Haver recess slope inwardly and upwardly. This arrangement permits the pedal to pivot inside the bike shoe recess. Consequently, during competition, while racing over rough terrain, the pedal can easily slip out of the recess so that time is lost while the rider is trying to reposition his feet on the pedal. This is admitted by Haver in his patent, when he states that his structure permits "easy disengagement of the pedal from the recess." This is the exact opposite of what is needed in competitive racing. Moreover, Haver does not locate his recess in alignment with the ball of the foot, which is also necessary for the maximum transfer of power.

The bike shoe described herein provides a stable relationship between the bike shoe and the pedal because the walls of the recess are perpendicular to the plane of the base of the recess and are spaced apart a distance generally equal to the width of the pedal to hold the pedal inside the recess. Consequently, the bike shoe cannot pivot inside the recess. With the recess in the shoe aligned with the ball of the foot, the foot does not exert any torque action on the pedal because the force from the foot is directed perpendicular to the surface of the pedal while the pedal is held parallel to the surface of the ground. This maximizes the transfer of power from the foot of the rider to the pedal of the bike. The reason is, if the center of the recess is located too far back from the center of the ball of the foot, the foot of the bike rider would have to be rotated upwardly in order to keep the pedal in the recess and if the center of the recess is located too far forward of the center of the ball of the foot, the foot would have to be rotated downward to keep the pedal in the recess. In either case, this would decrease power transmitted from the foot of the bike rider to the pedal of the bike.

What is needed therefore, and comprises an important object of this invention is to provide a bike shoe with a recess formed in the sole of the shoe which is sized to snugly embrace a bike pedal and which is located so when the rider wears the shoe, the center of the ball of the foot is aligned with the center of the recess.

This and other objects of this invention will become more apparent when better understood in the light of the accompanying specification and drawing wherein.

Figure 4:
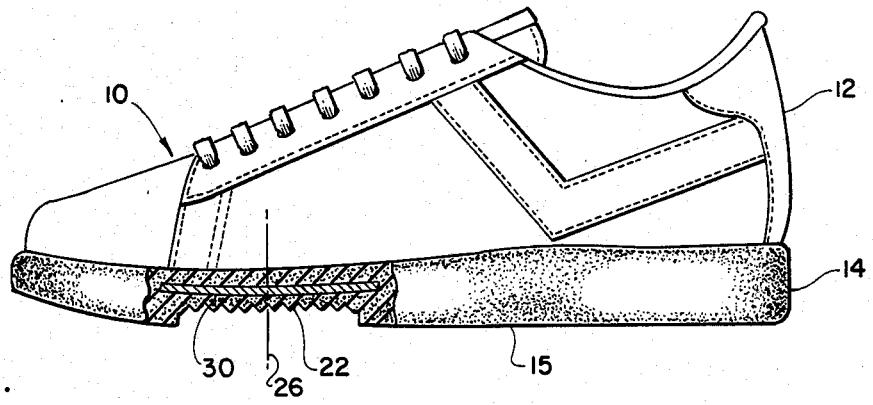

FIG. 4 discloses an elevational view of a modified bike shoe provided with a reinforcing shield mounted in the sole of the shoe above the base of the recess, both for controlling the resilence of the shoe and for protecting the foot of the bike rider.

Figure 1:
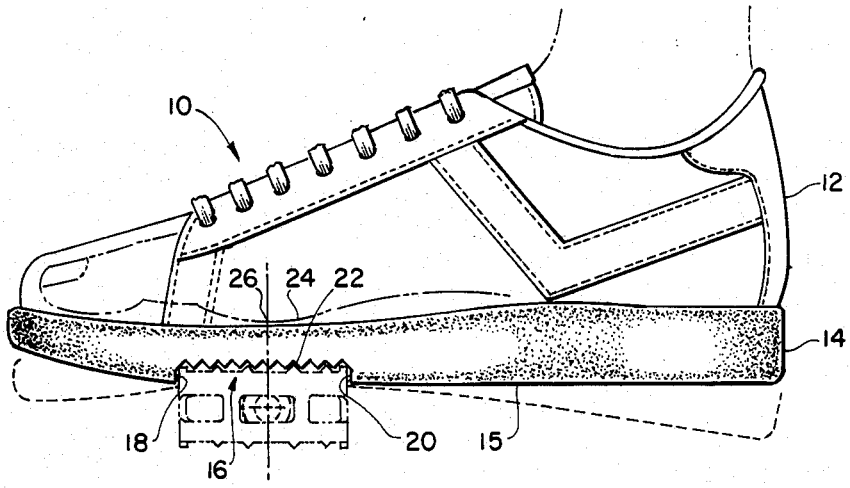
FIG. 1 is an elevational view of the bike shoe constructed according to the principles of this invention, disclosing a bike shoe with a pedal receiving recess formed in the sole of the shoe and showing the relationship between the ball of the foot inside the shoe and the pedal receiving recess.

Referring now to FIG. 1 of the drawing, a bike shoe indicated generally by the reference numeral 10 includes an upper portion 12 and a lower portion 14 preferably formed from an elastomeric material. The bottom of the sole of the shoe 15 is provided with a recess 16 extending from the opposite sides of the sole and defining a channel which in this embodiment is transverse to the sides of the shoe. This recess is defined by generally planar front and rear walls 18 and 20 which are transverse to a base 22. Base 22 is generally parallel to and in upwardly spaced relationship to the bottom of the sole. The front and rear walls 18 and 20 are spaced apart a distance corresponding to the width of the pedal, shown in phantom lines in FIG. 1 to provide a stable seat for the pedal inside the recess. With this arrangement, the opposite sides of the pedal will be in frictional engagement with the sides of the elastomeric walls 18 and 20 of the recess causing them to grip the sides of the pedal. Moreover, since the base of the recess is formed from an elastomeric material, the serrations on the edges of pedals used in Moto Cross competition become embedded in this elastomeric material. This further limits side to side movement of the pedal in the recess. These embedded serrations also prevent or minimize front and rear movement of the pedal inside the recess. With this arrangement, the pedal which will not pivot inside the recess so that the pedal will be snugly gripped in the recess and will be held in a stable position during competition.

Each shoe size has an inner sole portion 24 which receives the ball of the foot of the wearer. This determines the position of the recess 16 which must be located so that the center 26 of the ball of the foot is aligned with the center of the recess (see FIG. 1). With this arrangement, force exerted by the foot of the bike rider is directed perpendicular to the pedal. Consequently, maximum transfer of power from the bike rider to the pedal of the bike is achieved.

Figure 2:
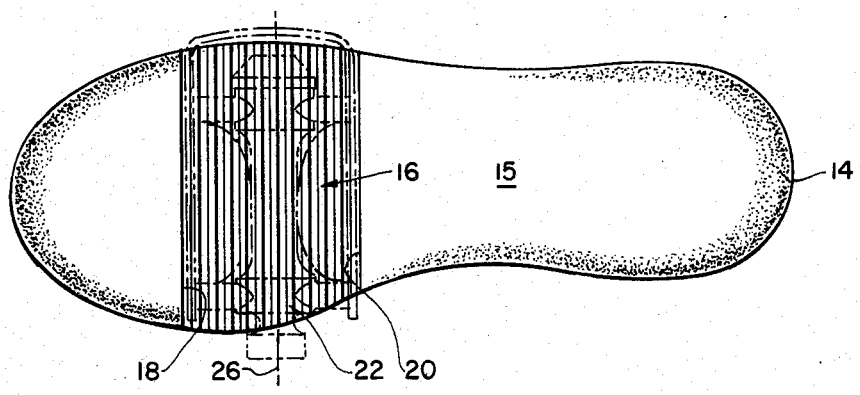
FIG. 2 is a bottom view of the shoe shown in FIG. 1, disclosing the recess in the sole of the shoe sized to receive a pedal which has straight parallel sides.
Figure 3:
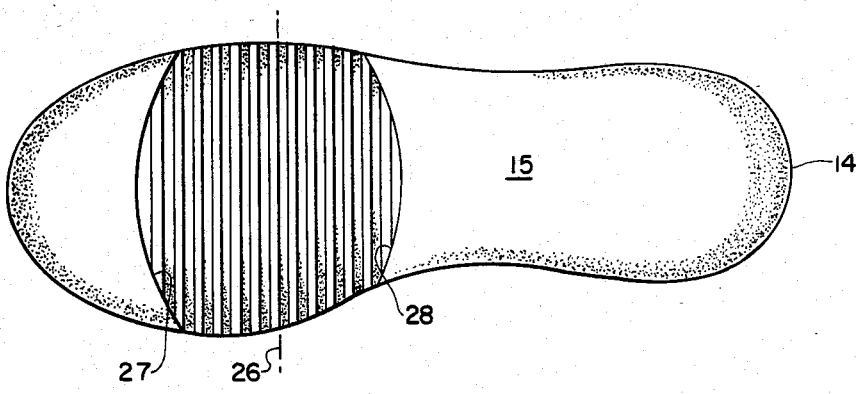
FIG. 3 is a bottom view of a modified bike shoe showing a recess in the sole of the shoe shaped to conform to a pedal having curved sides, so that the curved sides of the pedal when in the recess will be coextensive with and gripped by the walls of the recess.

Pedals currently in use on bikes used in Moto Cross competition have two shapes. One pedal shape has straight parallel sides as shown in phantom lines in FIG. 2. The other pedal shape has curved sides, see FIG. 3. The recess 16 is designed so the sides of the pedal will be coextensive with and will frictionally engage the walls of the recess to help retain the pedal in the recess during competition. This explains why the recess shown in FIG. 3 has curved sides 27 and 28 while the recess shown in FIG. 1 has straight sides.

As shown in FIG. 1, during competition, the front and rear of the shoe tends to bend or curve around the pedal. This helps achieve a better transfer of power from the foot of the rider to the pedal. In order to optimize this bending, a support 30 as shown in FIG. 4, formed from some suitably resilient material, and in the form of a plate, is embedded in the lower portion 14 parallel to and in upwardly spaced relation to the base 22 of the recess. The materials of the plate is selected to control the resilence of the shoe and the bending of the shoe around the pedal during competition. In addition, the plate has the added function of protecting the sole of the feet in the event the lower portion of the shoe fails during competition. Without this protective plate, and in the event of a failure of the lower portion 14 during intensive competition, the serrations on the edge of the pedal could come in contact with and lacerate the soles of the feet of the rider.

Having described the invention that I claim as new is:

1. A bike shoe for Moto Cross competition comprising an upper portion sized to receive a foot and an attached lower portion, said lower portion having a channel-like pedal embracing recess extending from the sides of the shoe, said recess defined by front and rear walls and a transverse inwardly and upwardly spaced base portion, said walls spaced apart a distance generally equal to the width of the pedal to provide a stable seat for the pedal in the recess and so when a pedal is in the recess, the walls of the recess grip the pedal and releasably keep the pedal in the recess, said recess during hard pedal positioned so the center of the recess is aligned with the center of the inner surface of the portion of the shoe which receives the ball of the foot, whereby the center of the ball of a foot of the bike rider is aligned with the center of the recess.

2. The bike shoe described in claim 1 wherein at least the walls of the recess in said lower portion are formed from an elastomeric material whereby the engagement between the said walls and the sides of the pedal cause the walls to grip the sides of the pedal to prevent side to side movement of the pedal in the recess to releasably retain the pedal in the recess in the bike shoe during hard pedaling yet permitting the shoe to be pulled off the pedal if the bicycle falls during competition.

3. The bike shoe described in claim 2 wherein at least the base of the recess is formed from an elastomeric material so when the pedal is in said recess, serrations on the edge of the pedal become embedded in said elastomeric material, thereby preventing side to side and front and back movement of the pedal inside said recess, whereby the pedal is releasably retained in the recess in the bike shoe during hard pedaling.

4. The bike shoe described in claim 1 including combined means for controlling the resilence of the bike shoe and for protecting the base of the foot of the bike rider from injury by the pedal in the event the lower portion of the bike shoe fails during competition.

5. The bike shoe described in claim 4 wherein said combined means comprises a resilient plate embedded in the lower portion of the shoe in upwardly spaced relationship to the base of the recess and parallel thereto.

6. The bike shoe described in claim 3 wherein the front and rear walls of the recess are straight and parallel to each other to accommodate pedals having parallel straight sides.

7. The bike shoe described in claim 3 wherein the front and rear walls of the recess are curved to accommodate pedals whose front and rear sides are similarly curved whereby the engagement between the curved front and rear walls of the recess and the curved front and rear sides of the pedals retain the pedal in the recess.

8. A bike shoe of the class described comprising an upper portion sized to receive a foot and an attached lower portion, said lower portion formed with a pedal embracing recess extending from the sides of the shoe, said recess defined by front and rear walls and a transverse inwardly and upwardly spaced base portion, said walls spaced apart a distance generally equal to the width of the pedal to provide a stable seat for the pedal in the recess and so the walls of the recess can grip the pedal and help keep the pedal in the recess, at least the base of the recess formed from an elastomeric material so metal serrations on the pedal of the bike can bite into the elastomeric material thereby preventing side to side and front and back movement of the pedal in the recess so that the pedal is releasably held in said recess during hard pedaling, said recess positioned in said lower portion so the center of the recess is aligned with the portion of the inner surface of the shoe which receives the ball of the foot in such a way that the center of the recess is aligned with the center of the ball of the foot of the bike rider for maximum transfer of power from the bike rider to the pedal of the bike.

9. The bike shoe described in claim 8 wherein the walls of the recess are formed from an elastomeric material to help grip the sides of the pedal to further limit side to side movement of the pedal in said recess to thereby help retain the pedal in the recess during competition, yet permitting the shoe to be pulled off the pedal in the event the bicycle falls during competition.

10. The bike shoe described in claim 9 including a resilient plate embedded in the lower portion of the shoe in upwardly spaced relationship to the base of the recess and parallel thereto for protecting the bottom of the foot of the bike rider from injury from the pedal in the event the lower portion of the bike shoe fails during competition, the resilence of said plate selected to control the bending of said shoe around the pedal during competition.

* * * * *